US009365988B2

(12) United States Patent
Driskell et al.

(10) Patent No.: US 9,365,988 B2
(45) Date of Patent: Jun. 14, 2016

(54) CONTINUOUS FLEXIBLE RETRO-REFLECTIVE ROADWAY MARKING DEVICE

(71) Applicant: Driskell Holdings LLC, St. Johns, FL (US)

(72) Inventors: Gregory Wayne Driskell, St. Johns, FL (US); Michael David Green, Chesterfield, MO (US)

( * ) Notice: Subject to any disclaimer, the term of this patent is extended or adjusted under 35 U.S.C. 154(b) by 67 days.

(21) Appl. No.: 14/376,572

(22) PCT Filed: Aug. 3, 2014

(86) PCT No.: PCT/US2014/049514

§ 371 (c)(1),
(2) Date: Aug. 4, 2014

(87) PCT Pub. No.: WO2015/020917

PCT Pub. Date: Feb. 12, 2015

(65) Prior Publication Data

US 2016/0010293 A1 Jan. 14, 2016

(51) Int. Cl.

| | |
|---|---|
| ***E01F 9/00*** | (2016.01) |
| ***E01F 9/053*** | (2006.01) |
| ***E01F 9/087*** | (2006.01) |
| ***E01F 9/07*** | (2006.01) |
| ***E01F 9/06*** | (2006.01) |
| ***E01F 9/04*** | (2006.01) |

(52) U.S. Cl.

CPC ..... *E01F 9/0533* (2013.01); *E01F 9/044* (2013.01); *E01F 9/06* (2013.01); *E01F 9/076* (2013.01); *E01F 9/087* (2013.01)

(58) Field of Classification Search

CPC ..... E01F 9/0533; E01F 9/087; E01F 9/076; E01F 9/06; E01F 9/044

USPC ..... 404/9, 12, 14, 73

See application file for complete search history.

(56) References Cited

U.S. PATENT DOCUMENTS

| | | | | | |
|---|---|---|---|---|---|
| 1,833,124 | A * | 11/1931 | Marchant | E01F 9/045 | 404/10 |
| 3,720,181 | A * | 3/1973 | Elkins | E01F 9/047 | 116/63 P |
| 3,971,623 | A * | 7/1976 | Hedgewick | E01F 9/06 | 359/531 |
| 4,515,499 | A * | 5/1985 | Furiate | E01F 9/0116 | 116/63 R |
| 4,618,281 | A * | 10/1986 | Ajemian | E01F 9/06 | 116/63 R |
| 5,230,582 | A * | 7/1993 | Schmitt | E01F 15/088 | 404/6 |
| D354,246 | S * | 1/1995 | Weid | D10/113.1 | |
| 5,639,179 | A * | 6/1997 | Jensen | E01F 9/053 | 404/16 |
| 5,837,350 | A * | 11/1998 | Jacobs | E01F 9/015 | 116/63 R |
| D468,225 | S * | 1/2003 | Tobler | D10/111 | |
| 2008/0069637 | A1 * | 3/2008 | Mize | E01F 9/03 | 404/9 |

* cited by examiner

*Primary Examiner* — Raymond W Addie
(74) *Attorney, Agent, or Firm* — Mark Young, P.A.

(57) ABSTRACT

A method of marking a curved median with a passive elongated flexible roadway marking device entails bending the device to conform to the curved bullnose shape of a roadway median, adhesively attaching the device to the surface of the median and then mechanically fastening the device to the median. Bending notches with stress relief vertices may be provided in a flange of the spline to facilitate concave bending of that flange. Attachment holes may be provided in flanges of the spline, in an alternating arrangement. Spaced apart retro-reflective tape strips are applied to the curved outer surface of the protrusion.

20 Claims, 9 Drawing Sheets

CONTINUOUS FLEXIBLE RETRO-REFLECTIVE ROADWAY MARKING DEVICE

RELATED APPLICATIONS

This application is a National stage filing of PCT International Application PCT/US14/49514 filed Aug. 3, 2014, which claims the benefit of priority of U.S. Nonprovisional application Ser. No. 13/958,710, filed Aug. 5, 2013, now patented as U.S. Pat. No. 8,734,048.

FIELD OF THE INVENTION

This invention relates generally to roadway marking, and, more particularly, to a method of roadway marking that entails bending an elongated flexible marking device in the shape of a curved median, affixing the device to the median with an adhesive and then securing the device with mechanical fasteners.

BACKGROUND

Roadway safety requires delineating travel lanes from curbing and other structures that may protrude into a roadway. Currently, retro-reflectors are mounted to guide rails or dedicated vertical support structures to help motorists identify a median or other structure. Frequently the retro-reflectors are substantially planar small devices that are responsive to incident light within a limited range of heights and directions. Problematically, such reflectors are frequently damaged, knocked out of position or completely knocked over, leaving the median or structure unmarked for motorist safety. Even when properly erected, the retro-reflector may be positioned a distance from a curb, making the curb structure difficult for a motorist to see at night.

Currently there is no method that is designed specifically to visually delineate the travel lanes from the curbing and other structures protruding into the vehicular travel way. The method should be conformable to various structures, easy to implement.

The invention is directed to overcoming one or more of the problems and solving one or more of the needs as set forth above.

SUMMARY OF THE INVENTION

To solve one or more of the problems set forth above, in an exemplary implementation of the invention, a method of marking a curved median with at least one marker is provided. The marker includes an elongated flexible spline having a first side, an opposite second side, a first end and an opposite second end, a top surface and an opposite bottom surface, a spline length of at least two feet from the first end to the second end, a spline width from the first side to the second side, and a spline thickness from the top surface to the bottom surface. A protrusion attached to the top surface of the spline has an outer surface, a profile shape, a protrusion length, a protrusion width and a protrusion height. The protrusion width is less than the spline width and the protrusion height is at least ½ inch. A first flange is coextensive with the first side and a second flange is coextensive with the second side. The protrusion is attached to the spline between the first flange and the second flange. A plurality of spaced apart retro-reflective elements is attached to the outer surface of the protrusion. Each of the retro-reflective elements cover a portion of the protrusion from about the first flange to the second flange.

The method includes locating a curved median without a marker. The curved median includes a periphery. A peripheral length of a portion of the curved median to be marked is determined. At least one marker is provided and positioned at the portion of the curved median to be marked. When positioned, the marker is bent to conform to the portion of the curved median to be marked, with the protrusion of the marker facing upwardly, and the bottom of the spline being against the surface of the portion of the curved median to be marked. Then the spline is attached flush to the surface of the portion of the curved median to be marked, with the marker bent to conform to the portion of the curved median to be marked. The median may be in a roadway having a road surface. In such case, the surface of the portion of the curved median to be marked is above the road surface. The step of attaching the spline flush to the surface of the portion of the curved median to be marked entails securing the marker to the surface of the portion of the curved median to be marked above the road surface.

In one embodiment, the marker may include a pressure sensitive adhesive with a removable backing on the bottom surface of the spline. In this embodiment, the spline may be adhesively attached flush to the surface of the portion of the curved median to be marked by removing the backing to expose the pressure sensitive roadway attaching adhesive and then applying pressure to the spline to marry the adhesive with the surface of the portion of the curved median to be marked.

In one embodiment, the first flange and the second flange may include a plurality of flange holes for attachment using mechanical fasteners, such as threaded fasteners. Each threaded fastener includes a threaded shaft and an engageable head. The step of attaching the spline flush to the surface of the portion of the curved median to be marked includes forming a plurality of median holes in the portion of the curved median to be marked beneath and in alignment with flange holes, and threading the threaded shaft of each threaded fastener through one of the flange holes and into one of the median holes aligned with and beneath the one of the flange holes.

In one embodiment, the marker includes a plurality of spaced apart notches in the first flange. The notches facilitate bending. Bending forms a concave side and an opposite convex side, with the notched first flange defining the concave side.

In one embodiment, the marker may include a plurality of marker segments and marker joints. In such embodiment, the method further entails joining the plurality of marker segments using the marker joints.

The marker body, including the spline, the protrusion, the first flange and the second flange, may be integrally formed by extrusion. Spaced apart retro-reflective elements may be attached to the outer surface of the protrusion, with each of the retro-reflective elements covering a portion of the protrusion from about the first flange to the second flange. A plurality of spaced apart notches (e.g., v-shaped notches with stress relief vertices) may be cut into the first flange to facilitate bending. A plurality of flange holes for mechanical attachments may be formed in the flanges.

The marker body, including the spline, the protrusion, the first flange and the second flange, may be integrally formed by extrusion. Spaced apart retro-reflective elements may be attached to the outer surface of the protrusion, with each of the retro-reflective elements covering a portion of the protrusion from about the first flange to the second flange. A plurality of spaced apart notches (e.g., v-shaped notches with stress relief vertices) may be cut into the first flange to facilitate bending. A plurality of flange holes for mechanical attachments may be formed in the flanges.

BRIEF DESCRIPTION OF THE DRAWINGS

The foregoing and other aspects, objects, features and advantages of the invention will become better understood with reference to the following description, appended claims, and accompanying drawings, where:

Figure 1:
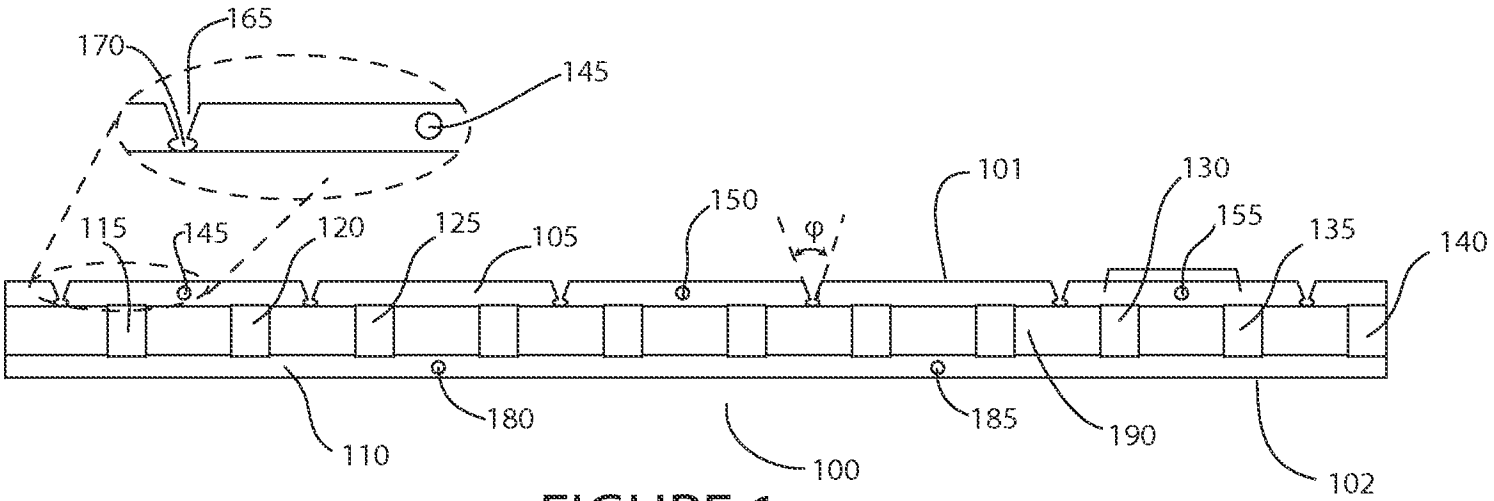
FIG. 1 is a plan view of a continuous flexible retro-reflective roadway marking device according to principles of the invention.
Figure 2:
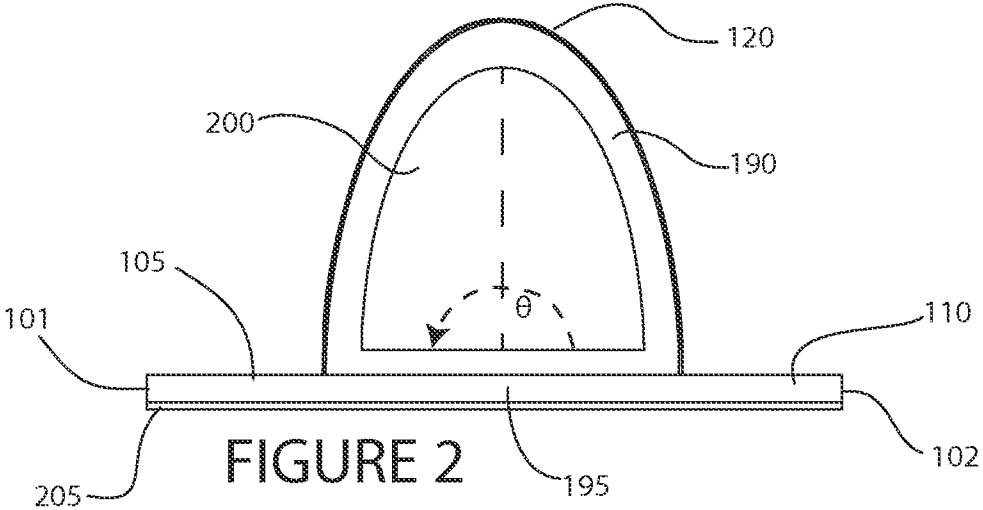
FIG. 2 is a profile view of a continuous flexible retro-reflective roadway marking device according to principles of the invention.
Figure 3:
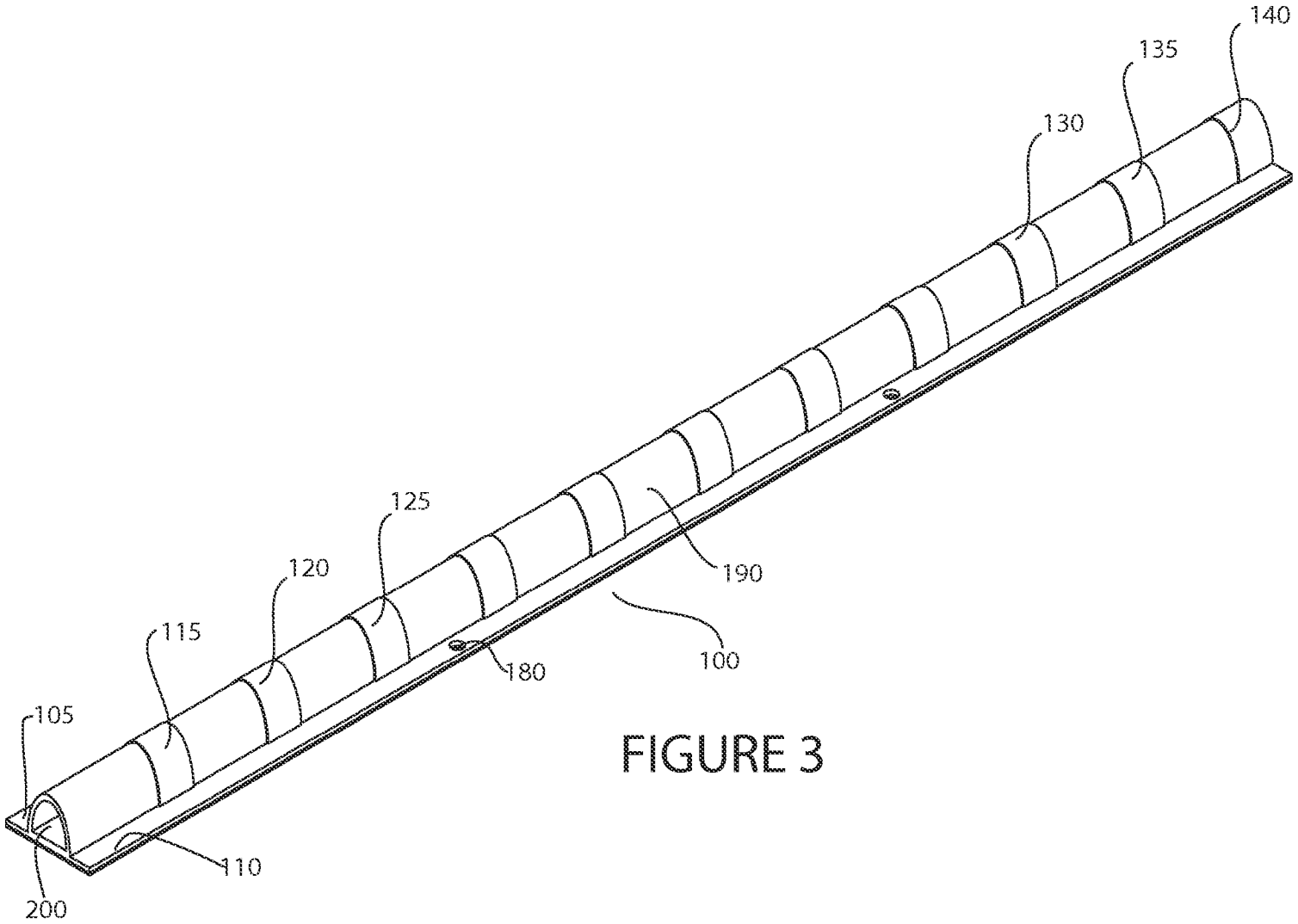
FIG. 3 is a first perspective view of a continuous flexible retro-reflective roadway marking device according to principles of the invention.
Figure 4:
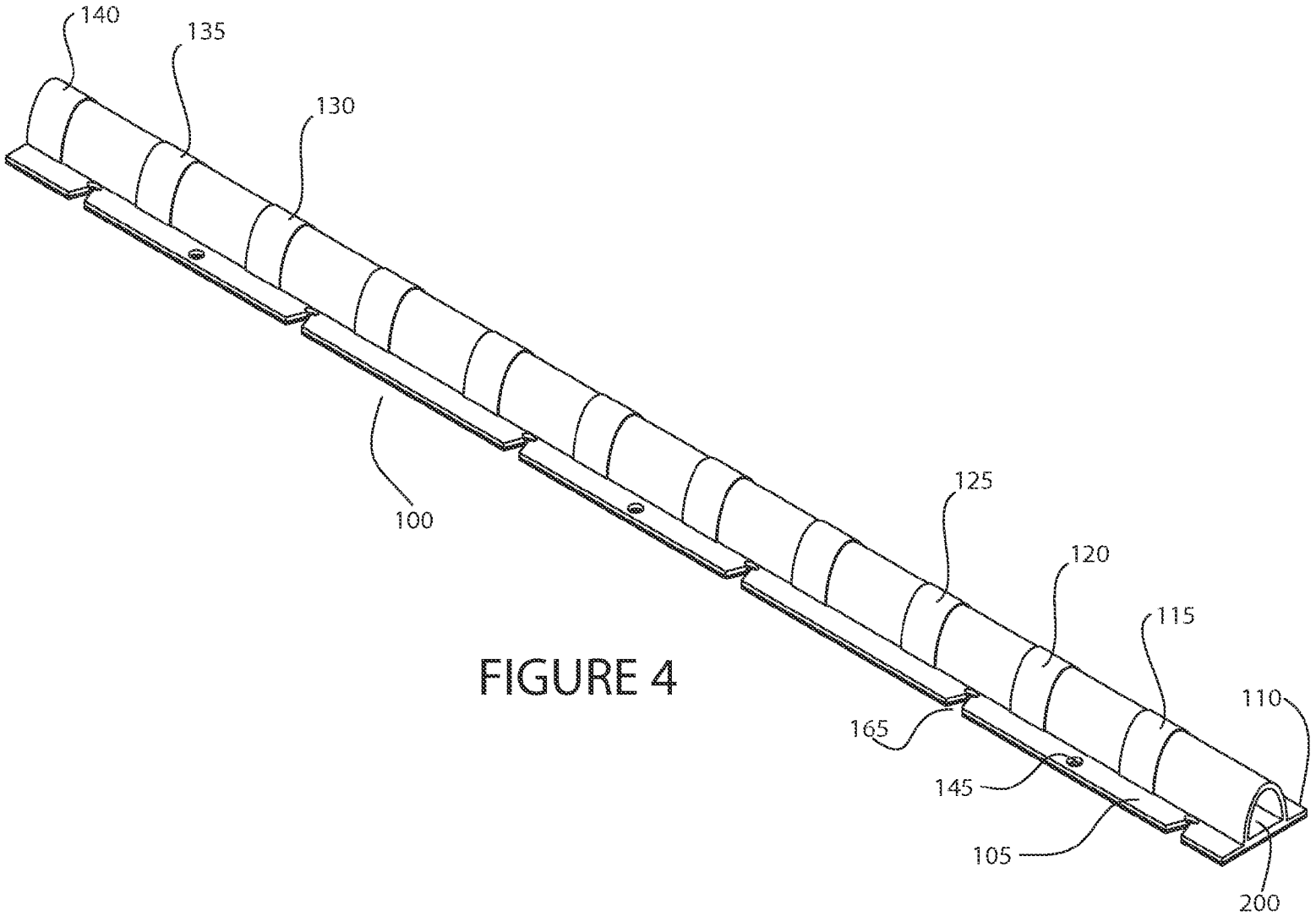
FIG. 4 is a second perspective view of a continuous flexible retro-reflective roadway marking device according to principles of the invention.

Those skilled in the art will appreciate that the figures are not intended to be drawn to any particular scale; nor are the figures intended to illustrate every embodiment of the invention. The invention is not limited to the exemplary embodiments depicted in the figures or the specific components, configurations, shapes, relative sizes, ornamental aspects or proportions as shown in the figures.

DETAILED DESCRIPTION

Referring to FIGS. 1 through 4, various view of a passive elongated flexible roadway marking device 100 according to principles of the invention are provided. The device 100 is an elongated flexible structure comprised of an elongated flexible plastic spline 195, with a D-shape or similar profile protrusion 190 that is coextensive with the spline 195. While a D-shaped profile is preferred, other profiles having an alternative profile shape that includes a curved or faceted surface extending more than 90 degrees (i.e., $\theta \geq 90°$) may be utilized. As used herein, D-shape includes a profile shape with a linear portion attached to a curved portion. The linear portion has two terminal ends. The curved portion has two terminal ends. One end of a terminal curved portion attaches to one end of a linear portion. The other end of the curved portion attaches to the other end of the linear portion. The curved portion may comprise a smooth curve, an angular arrangement of adjoining segments and/or a faceted curve. The "curved" portion may be C-shaped, U-shaped, V-shaped, semicircular or otherwise arc shaped. A shape with the angle equal or about equal to 180 degrees is preferred. The protrusion height and width are preferably at least about 1 inch and more preferably 1.25 inches in width and height. However, other dimensions, including 0.75 to 3 inches in height and/or width may be utilized within the scope of the invention. The surface of the protrusion 190 supports retro-reflective elements 115-140 that reflects light from nearby, particularly, approaching vehicles, no matter the height of the vehicle or elevation of the approaching roadway relative to the roadway marking device. In the exemplary illustrated embodiment the protrusion 190 is hollow, with a channel 200 extending through the protrusion 190. Light emanating from headlamps of an approaching vehicle will always strike a portion of the device 100, which will include one or more retro-reflective elements 115-140.

The channel 200 serves a few purposes. First, the channel 200 provides a female receptacle suitable for receiving a male connector to join separate units of the device together. Concomitantly, the channel 200, which makes the protrusion 190 hollow, allows the protrusion to collapse when impacted. Thus, for example, when a load is applied, such as when a vehicle passes onto the protrusion 190, the protrusion will collapse. As the protrusion 190 is comprised of a resilient elastomer, it tends to return to its undeformed state after a load is removed.

The spline 195 is a generally rectangular elongated planar flexible strip having a length (l) and a width (w) and a thickness (t). The length, width and thickness may vary. However, a thickness between 0.0625 inches and 0.25 inches, a width between 1.5 to 3 inches (e.g., about 2.5 inches) and a length of a foot or longer are preferred (e.g., 3-feet, 1-meter, 4-feet, 6-feet, 2-meters) may be utilized.

Being wider than the protrusion 190, the spline 195 has side edges that extend beyond the D-shaped protrusion 190, thus providing flanges 105, 110. The flanges 105, 110 include a first flange 105 and an opposite second flange 110. The first flange 105 is an inward flange facing the first side 101, an inward side. The second flange 110 is an outward flange, facing the second side 102, an outward side.

A plurality of spaced apart v-notches 165 with stress relief circular vertices 170 are cut into one of the flanges (e.g., the first flange), along the edge of the flange, to facilitate bending into a curve that conforms to the curvature of a median nose of a traffic median. Each notch 165 may define an acute angle, $\phi$, though larger angles may be utilized within the scope of the invention. In one exemplary embodiment, the v-notches 165 are spaced apart at 6" centers. In this embodiment, the other flange 110 does not include v-notches or slits if the spline 195 is pliable without notches or slits. However, in an alternative embodiment, a plurality of spaced apart slits with stress relief circular vertices may be cut into the other flange (e.g., the second flange), along the edge of the flange, to facilitate bending into a curve that fits flush against a median nose of a traffic median. If slits are provided, they may be formed opposite the v-notches.

A plurality of spaced apart reflective elements 115-140 are provided on the D-shaped protrusion 190. The reflective elements 115-140 conform to the curvature of the curved surface of the D-shaped protrusion 190. The reflective elements 115-140 include a reflective surface that faces outwardly. In an exemplary embodiment, the reflective elements 115-140 comprise strips of retro-reflective tape 115-140 wrapped around sections of the curved D-shaped protrusion 190. In a particular preferred embodiment, the reflective elements 115-140 comprise strips of abrasion resistant retro-reflective tape 115-140 wrapped around sections of the curved D-shaped protrusion 190. By way of example and not limitation, the tape 115-140 may comprise 1-inch wide strips spaced apart at 3-inch centers. Additionally, in a preferred embodiment, the strips of tape 115-140 are arranged so that no strip is directly across (i.e., aligned with) a v-notch. The strips are wrapped around the exposed (i.e., outwardly facing) side of the protrusion 190 to provide retro-reflectivity along both sides 101, 102 of the device 100. The color of the tape 115-140 may vary to meet requirements and preferences. The spaced apart strips of tape 115-140 cover all or substantially all of the underlying portion of the protrusion 190 over which the tape 115-140 is applied. Thus, the tape 115-140 provides a reflective surface that is reactive to light from a wide range of angles of incidence impacting the protrusion 190 from either side 101, 102. Thus, the tape provides a retro-reflective surface despite the slope of the median. Concomitantly, the tape provides a retro-reflective surface for vehicles approaching from either direction.

A plurality of anchor holes 145, 150, 155, 180, 185 for receiving screws for fastening the spline 195 to substrate (e.g., concrete) using appropriate fasteners (e.g., masonry screws) are provided along each flange. The holes 145, 150, 155, 180, 185 may be spaced apart a determined distance, e.g., 12 inches, measured from hole 145, 150, 155, 180, 185 centers. Other distances between hole 145, 150, 155, 180, 185 centers may be used without departing from the scope of the invention. On a flange with v-notches, the anchor holes 145, 150, 155, 180, 185 are provided between v-notches. On the opposite flange, the anchor holes 145, 150, 155, 180, 185 are provided at locations between the holes 145, 150, 155, 180, 185 on the notched flange. In this manner, the holes 145, 150, 155, 180, 185 on opposite flanges alternate along the longitudinal axis of the spline 195.

A pressure sensitive adhesive 205 with a removable backing is provided on the bottom of the spline 195 to hold the spline 195 in place during installation. The pressure sensitive adhesive 205 forms a bond when pressure is applied to marry the adhesive with the adherend. No solvent, water, or heat is needed to activate the adhesive. While any pressure sensitive adhesive useful for bonding to concrete may be used, adhesives with a butyl rubber elastomer and compatible tackifier are preferred. A peel away backing exposes the pressure sensitive adhesive 205 for bonding.

Figure 9:
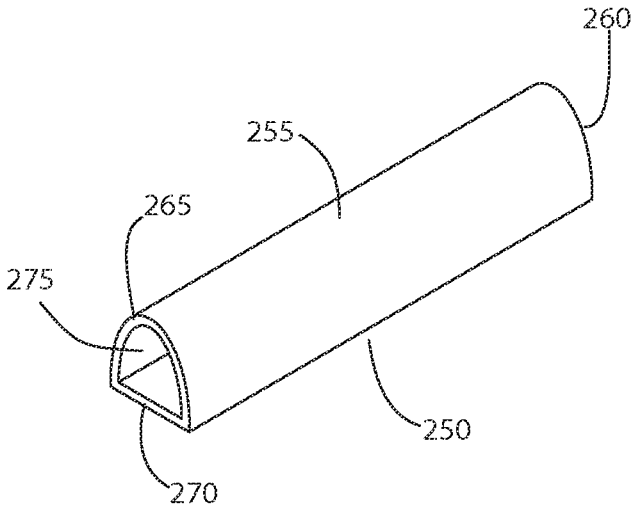
FIG. 9 is a perspective view of an exemplary male coupling for a continuous flexible retro-reflective roadway marking device according to principles of the invention.

A coupling is provided to connect separate units of the marking device 100. By way of example and not limitation, a separate male D-shaped coupling, as shown in FIG. 9, engages and couples the female ends of abutting spline 195*s*. The D-shaped coupling includes a planar bottom surface 270, a curved top surface 255, a hollow central channel 275, a first end 260 and an opposite second end 270. The D-shaped coupling is shaped and sized to fit snugly into the D-shaped hollow opening of the protrusion 190. As an alternative to a D-shaped coupling, a properly sized thick walled semi-flexible elastomeric hose (e.g., a rubber hose) cut to a determined length (e.g., 6 inches) may serve as a male connector. The outer diameter of the hose should fit snugly within the channel 200 of the marking device. The coupling, thus, frictionally secures the separate units of the marking device 100. Optionally, a glue or bonding agent may be applied to permanently secure the coupling in the adjoined units. Other couplings, including, without limitation, snap fit connectors and integrally formed male and male and female couplings may be utilized within the scope of the invention. Alternatively, separate units of the marking device 100 may be adhered together using a glue or bonding agent. As another alternative, separate units of the marking device 100 may be located in abutting or adjacent relationship without coupling or adhering together.

The spline 195 and protrusion 190 of the marking device 100 can be made from high impact plastic, rubber, or other suitable material which will resiliently deflect upon contact with vehicle wheels without permanent damage. Thus, a vehicle should be able to ride over the protrusion 190 without destroying the marking device 100.

The protrusion 190 and spline 195 are not limited to any particular material, except that the chosen material should exhibit sufficient durability, flexibility and resiliency to serve as a marking device 100, withstand a vehicle and bend to conform to the shape of an intersection. In an exemplary embodiment plastic is used to form the protrusion 190 and spline 195, preferably a substantially strong, solid, yet lightweight material. By way of example and not limitation, the protrusion 190 and spline 195 may be comprised of high density polyethylene or polyvinyl chloride (PVC). However, other plastics may be used. Other exemplary plastics include rubber, recycled rubber, nylon, silicone, polysulfone, polyethylene, polypropylene, polystyrene, acrylics, cellulosics, acrylonitrile-butadiene-styrene terpolymers, urethanes, thermo-plastic resins, thermo-plastic elastomers (TPE), acetal resins, polyamides, polycarbonates and/or polyesters. Preferably the chosen material is relatively inexpensive, produces a durable, flexible and strong product, is easy to use in manufacturing operations and results in an aesthetically acceptable product. The material may further include additives to provide desired properties such as desired colors, structural characteristics, and phosphorescent or glow-in-the dark properties, and UV protection.

The protrusion 190 and spline 195 may be produced using any suitable manufacturing techniques known in the art for the chosen material, such as (for example) extrusion, injection, compression, structural foam, blow, or transfer molding; polyurethane foam processing techniques; vacuum forming; casting; machining; and milling. In a preferred embodiment, the spline 195 and protrusion 190 are integrally formed by extrusion. Then the retro-reflective tape 115-140 strips and adhesive are applied. Preferably the manufacturing techniques are suitable for mass production at relatively low cost per unit, and results in an aesthetically acceptable product with a consistent acceptable quality and structural characteristics.

Figure 5:
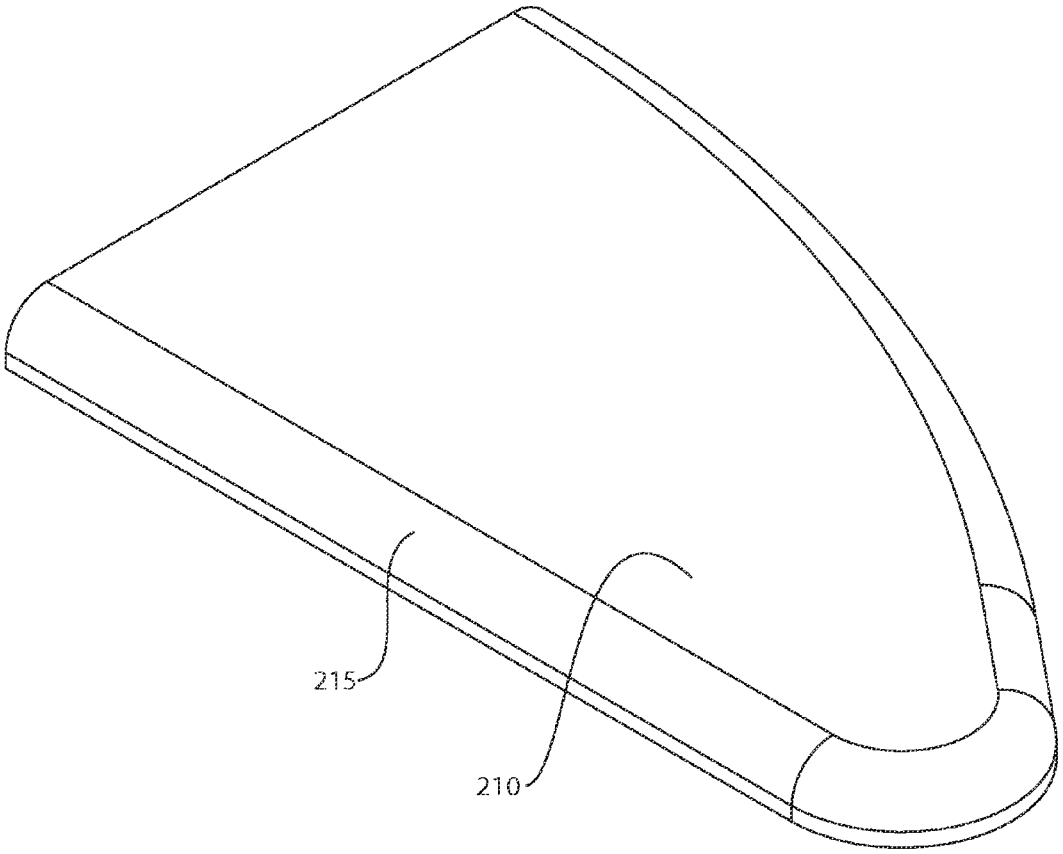
FIG. 5 is a perspective view of an exemplary median nose section of a roadway median suitable for receiving a continuous flexible retro-reflective roadway marking device according to principles of the invention.
Figure 6:
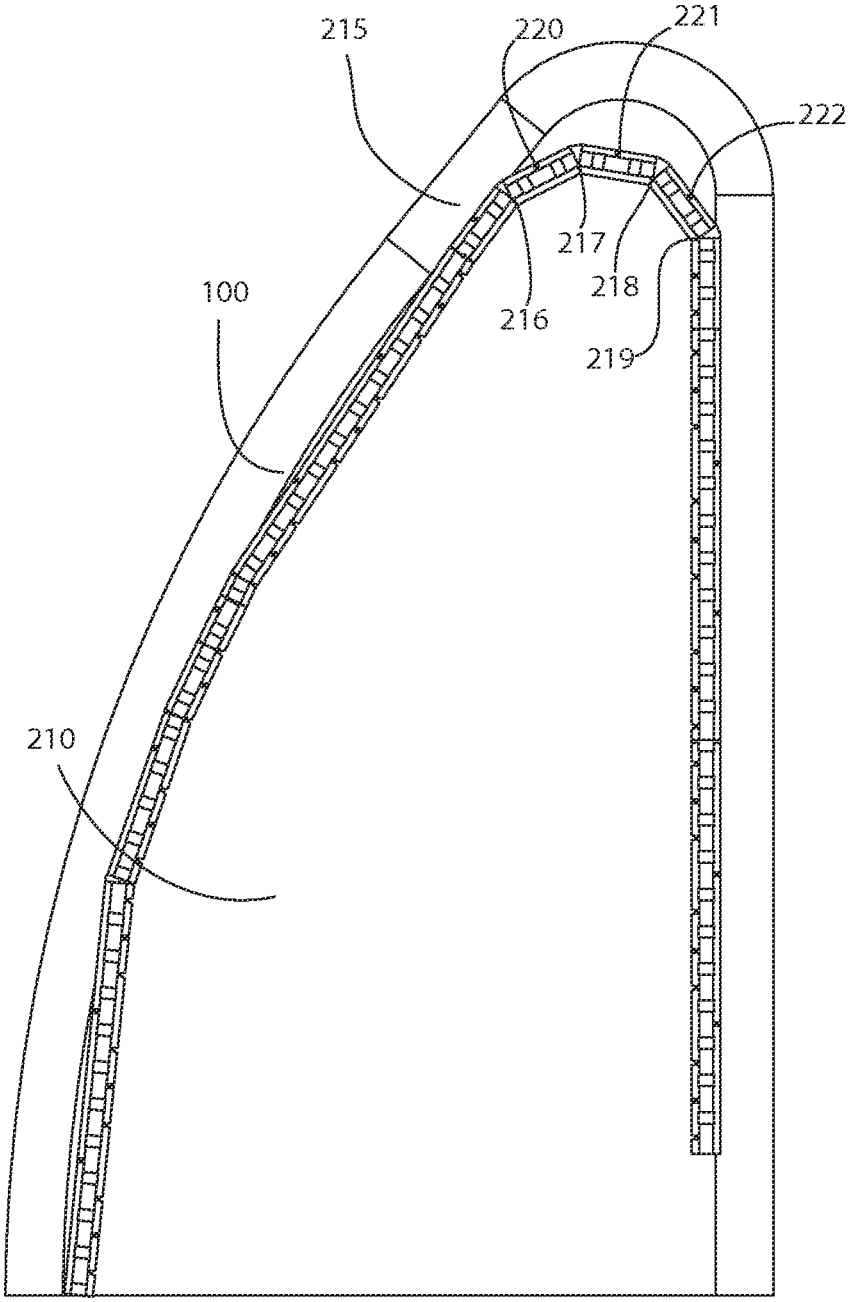
FIG. 6 is a plan view of an exemplary median nose section of a roadway median equipped with a continuous flexible retro-reflective roadway marking device according to principles of the invention.
Figure 7:
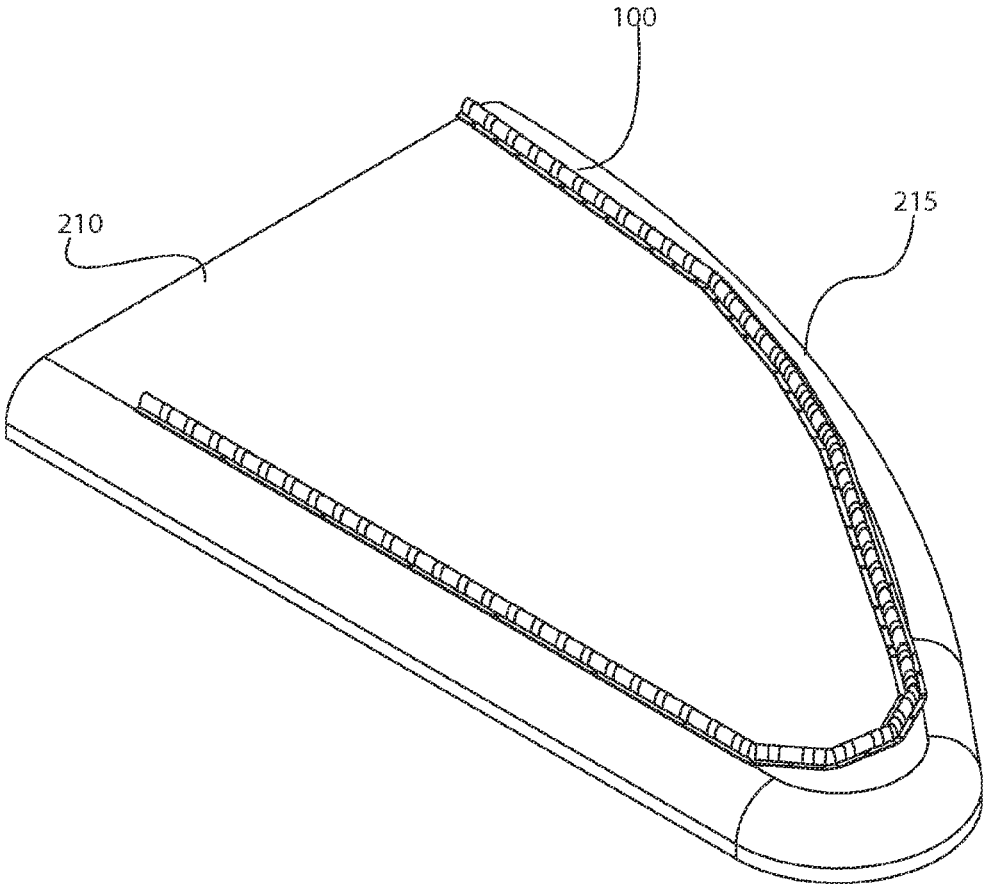
FIG. 7 is a first perspective view of an exemplary median nose section of a roadway median equipped with a continuous flexible retro-reflective roadway marking device according to principles of the invention.
Figure 8:
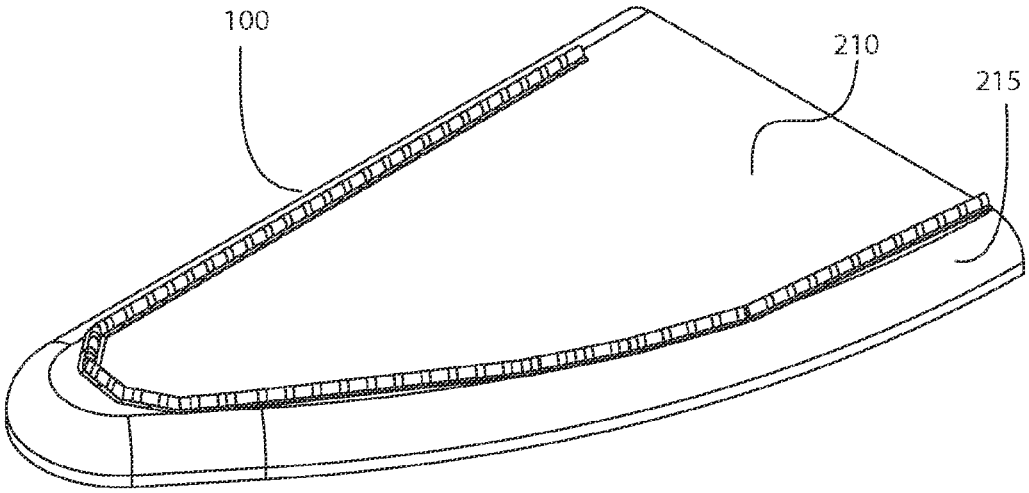
FIG. 8 is a second perspective view of an exemplary median nose section of a roadway median equipped with a continuous flexible retro-reflective roadway marking device according to principles of the invention.

FIG. 5 provides a perspective view of an exemplary median nose section 210 of a roadway median suitable for receiving a passive elongated flexible roadway marking device 100 according to principles of the invention. A curb 215 defines the perimeter of the median nose section 210. Several marking devices 100 according to principles of the invention may be attached to the top surface of the median nose 210 and bent to generally conform to the shape of the median nose 210 as conceptually illustrated in FIGS. 6, 7 and 8. While these drawings are not to scale, they help illustrate bending characteristics of a continuous flexible retro-reflective roadway marking device according to principles of the invention. The several marking devices may be coupled together using the male coupling described above. With reference to FIG. 6, notches 216-219 of the segments at the leading edge are shown in a collapsed configuration, to facilitate bending to conform to the shape of the median nose. Attachment holes 220-222 allow the segments to be securely fastened to the median.

While the marking device 100 is shown attached to the top surface of the median, it is not so limited. Rather, the marking device 100 may be attached to the curb of the median, such as near the top surface. The flexibility of the device 100 permits such use.

The marking device 100 will be visible to a vehicle approaching the median 210 from any traffic direction. The retro-reflective elements 115-140 of the marking device 100 will reflect light emitted from headlamps of such vehicles no matter what the angle of incidence may be.

Figure 10:
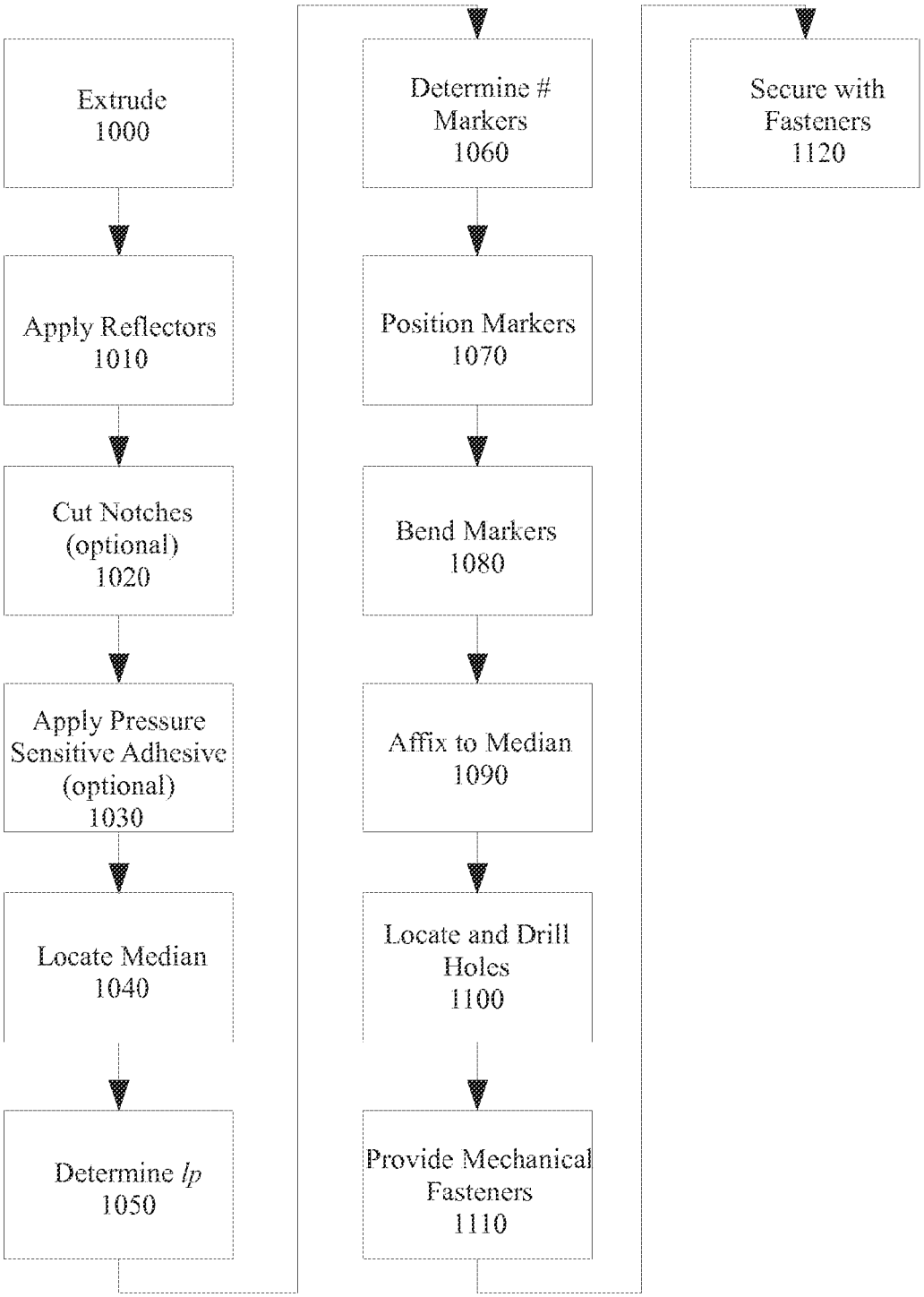
FIG. 10 provides a high level flowchart of a method of marking a curved median with at least one marker according to principles of the invention.

With reference to the flowchart of FIG. 10, a method of marking a curved median with a marker is provided. An exemplary marker is described above. However, markers that differ from the marker described above may be utilized within the scope of the method. In a nonlimiting exemplary implementation, the marker comprises an integrally formed extruded body to which reflecting elements are attached, as indicated in step 1000. The exemplary marker includes a spline, which is elongated and flexible and has a first side, an opposite second side, a first end and an opposite second end, a top surface and an opposite bottom surface, a spline length from the first end to the second end, a spline width from the first side to the second side, and spline thickness from the top surface to the bottom surface. A protrusion is attached to or formed on the top surface of the spline. The protrusion has an outer surface, a profile shape, a protrusion length, a protrusion width and a protrusion height, the protrusion width being less than the spline width and the protrusion height being at least ½ inch. A first flange is coextensive with the first side and a second flange is coextensive with the second side. The protrusion is attached to the spline between the first flange and the second flange. A plurality of spaced apart retro-reflective elements are attached to the outer surface of the protrusion, each of the retro-reflective elements covering a portion of the protrusion from about the first flange to the second flange, as indicated in step 1010.

The method entails locating a curved median that does not have an adequate marker, as in step 1040. The median has a periphery that delineates median in a roadway. A peripheral length ($l_p$) of the portion of the curved median to be marked is determined, as in step 1040. This length may be determined using a measuring tape, scale drawings, or other suitable measuring or estimation techniques. Then, the number of markers required to extend the determined peripheral length is determined, as in step 1060. Thus, one or more markers is provided to extend the measured length. Each marker is positioned on the surface of the portion of the curved median to be marked, as ins step 1070, and then bent to conform to that portion of the curved median, as in step 1080. The spline is adhesively affixed flush to the surface of the portion of the curved median to be marked, with the marker bent to conform to the portion of the curved median to be marked, as in step 1090. The adhesive attachment holds the spline in place until mechanical fasteners are applied later in the process. The adhesive helps ensure conforming and flush attachment. Then a plurality of mechanical fasteners are provided. After adhesively attaching the spline flush to the surface of the portion of the curved median to be marked, the marker is secured to the surface of the portion of the curved median to be marked using the mechanical fasteners.

In one embodiment, the marker includes a pressure sensitive roadway attaching adhesive on the bottom surface of the spline, as indicated in step 1030. The adhesive may be coextruded with the spline or applied to the spline after extrusion of the spline. In this embodiment, the step of adhesively attaching the spline flush to the surface of the curved median includes applying pressure to the spline to marry the adhesive with the surface, as in step 1090. The pressure sensitive roadway attaching adhesive may further include a removable backing, in which case the step of adhesively attaching the spline to the surface of the portion of the curved median to be marked includes removing the removable backing to expose the pressure sensitive roadway attaching adhesive before applying pressure to the spline to marry the adhesive with the surface of the portion of the curved median to be marked.

In one embodiment, the flanges may have a plurality of flange holes for attachments with threaded mechanical fasteners that include a threaded shaft and an engageable head (e.g., screw or bolt head). Median holes are formed (e.g., drilled) in the portion of the curved median to be marked beneath and in alignment with flange holes, as in step 1100. Mechanical fasteners are provided for each the flange holes, in accordance with step 1110. The threaded shaft of each threaded fastener may then be threaded through a flange hole and into one of the median holes aligned with and beneath the flange hole, to secure the marker to the median, as in step 1120.

The median may be in a roadway. The roadway has a road surface. The surface of the portion of the curved median to be marked is above the road surface. When the marker is secured to the surface of the portion of the curved median to be marked using the mechanical fasteners it is secured to the surface of the portion of the curved median to be marked above the road surface (i.e., at a height above the road surface).

In one embodiment, one of the flanges (e.g., the first flange) includes notches that facilitate bending of the device. The notches may be cut into the flange, as in step 1020. Stress relief vertices (e.g., circular vertices) may also be cut into the notches to relieve stress. The step of bending the marker to conform to the portion of the curved median to be marked entails bending the a marker to form a concave side and an opposite convex side. The first flange (i.e., the flange with the notches) is positioned at the concave side and the second flange (i.e., flange opposite to the flange with notches) is positioned at the convex side of the marker. In this manner, the bending does not cause bunching and gaps at the notched flange, and the opposite flange stretches to accommodate the bend.

The markers may have joints (e.g., mating male and female elements or snap fit connections) to connect one or more markers into an elongated structure. Thus, the marker may be a determined length. Several markers may be connected to fit a particular peripheral length ($l_p$). A marker may be cut, if appropriate, to fit.

Using the methodology, a substantially conforming and flush fitting median marker is provided on a roadway median. The bend of the marker follows the contour of the median. Thus, motorists and pedestrians may see an accurate representation of the median at night. The flush fit avoids gaps between the median and the marker that may otherwise compromise integrity of the attachment.

In sum, a method of marking a curved median with at least one marker is provided. The marker includes an elongated flexible spline having a first side, an opposite second side, a first end and an opposite second end, a top surface and an opposite bottom surface, a spline length of at least two feet from the first end to the second end, a spline width from the first side to the second side, and a spline thickness from the top surface to the bottom surface. A protrusion attached to the top surface of the spline has an outer surface, a profile shape, a protrusion length, a protrusion width and a protrusion height. The protrusion width is less than the spline width and the protrusion height is at least ½ inch. A first flange is coextensive with the first side and a second flange is coextensive with the second side. The protrusion is attached to the spline between the first flange and the second flange. A plurality of spaced apart retro-reflective elements is attached to the outer surface of the protrusion. Each of the retro-reflective elements cover a portion of the protrusion from about the first flange to the second flange. The method includes locating a curved median without a marker. The curved median includes a periphery. A peripheral length of a portion of the curved median to be marked is determined. At least one marker is provided and positioned at the portion of the curved median to be marked. When positioned, the marker is bent to conform to the portion of the curved median to be marked, with the protrusion of the marker facing upwardly, and the bottom of the spline being against the surface of the portion of the curved median to be marked. Then the spline is attached flush to the surface of the portion of the curved median to be marked, with the marker bent to conform to the portion of the curved median to be marked. The median may be in a roadway having a road surface. In such case, the surface of the portion of the curved median to be marked is above the road surface. The step of attaching the spline flush to the surface of the portion of the curved median to be marked entails securing the marker to the surface of the portion of the curved median to be marked above the road surface.

In one embodiment, the marker may include a pressure sensitive adhesive with a removable backing on the bottom surface of the spline. In this embodiment, the spline may be adhesively attached flush to the surface of the portion of the curved median to be marked by removing the backing to expose the pressure sensitive roadway attaching adhesive and then applying pressure to the spline to marry the adhesive with the surface of the portion of the curved median to be marked.

In one embodiment, the first flange and the second flange may include a plurality of flange holes for attachment using mechanical fasteners, such as threaded fasteners. Each threaded fastener includes a threaded shaft and an engageable head. The step of attaching the spline flush to the surface of the portion of the curved median to be marked includes forming a plurality of median holes in the portion of the curved median to be marked beneath and in alignment with flange holes, and threading the threaded shaft of each threaded fastener through one of the flange holes and into one of the median holes aligned with and beneath the one of the flange holes.

In one embodiment, the marker includes a plurality of spaced apart notches in the first flange. The notches facilitate bending. Bending forms a concave side and an opposite convex side, with the notched first flange defining the concave side.

In one embodiment, the marker may include a plurality of marker segments and marker joints. In such embodiment, the method further entails joining the plurality of marker segments using the marker joints.

The marker body, including the spline, the protrusion, the first flange and the second flange, may be integrally formed by extrusion. Spaced apart retro-reflective elements may be attached to the outer surface of the protrusion, with each of the retro-reflective elements covering a portion of the protrusion from about the first flange to the second flange. A plurality of spaced apart notches (e.g., v-shaped notches with stress relief vertices) may be cut into the first flange to facilitate bending. A plurality of flange holes for mechanical attachments may be formed in the flanges.

The marker body, including the spline, the protrusion, the first flange and the second flange, may be integrally formed by extrusion. Spaced apart retro-reflective elements may be attached to the outer surface of the protrusion, with each of the retro-reflective elements covering a portion of the protrusion from about the first flange to the second flange. A plurality of spaced apart notches (e.g., v-shaped notches with stress relief vertices) may be cut into the first flange to facilitate bending. A plurality of flange holes for mechanical attachments may be formed in the flanges.

While an exemplary embodiment of the invention has been described, it should be apparent that modifications and variations thereto are possible, all of which fall within the true spirit and scope of the invention. With respect to the above description then, it is to be realized that the optimum relationships for the components and steps of the invention, including variations in order, form, content, function and manner of operation, are deemed readily apparent and obvious to one skilled in the art, and all equivalent relationships to those illustrated in the drawings and described in the specification are intended to be encompassed by the present invention. The above description and drawings are illustrative of modifications that can be made without departing from the present invention, the scope of which is to be limited only by the following claims. Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents are intended to fall within the scope of the invention as claimed.

What is claimed is:

1. A method of marking a curved median with at least one marker, said marker comprising a spline, said spline being elongated and flexible and having a first side, an opposite second side, a first end and an opposite second end, a top surface and an opposite bottom surface, a spline length of at least two feet from the first end to the second end, a spline width from the first side to the second side, and spline thickness from the top surface to the bottom surface, a protrusion attached to the top surface of the spline, said protrusion having an outer surface, a profile shape, a protrusion length, a protrusion width and a protrusion height, the protrusion width being less than the spline width and the protrusion height being at least ½ inch, a first flange coextensive with the first side and a second flange coextensive with the second side, and said protrusion being attached to the spline between the first flange and the second flange, a plurality of spaced apart retro-reflective elements attached to the outer surface of the protrusion, each of the retro-reflective elements covering a portion of the protrusion from about the first flange to the second flange, and said method comprising steps of:

locating a curved median without a marker, said curved median including a periphery;

determining a peripheral length of a portion of the curved median to be marked, said portion of the median to be marked including a surface;

providing at least one marker;

positioning the at least one marker at the portion of the curved median to be marked;

bending the at least one marker to conform to the portion of the curved median to be marked, with the protrusion of the marker facing upwardly, and the bottom of the spline being against the surface of the portion of the curved median to be marked;

attaching the spline flush to the surface of the portion of the curved median to be marked, with the marker bent to conform to the portion of the curved median to be marked.

2. The method of marking a curved median with at least one marker according to claim 1, said marker further comprising a pressure sensitive roadway attaching adhesive attached to the bottom surface of the spline; and said step of attaching the spline flush to the surface of the portion of the curved median to be marked comprising adhesively attaching the spline flush to the surface of the portion of the curved median to be marked, with the marker bent to conform to the portion of the curved median to be marked further comprising applying pressure to the spline to marry the adhesive with the surface of the portion of the curved median to be marked.

3. The method of marking a curved median with at least one marker according to claim 2, said pressure sensitive roadway attaching adhesive further comprising a removable backing, and said step of adhesively attaching the spline to the surface of the portion of the curved median to be marked, with the marker bent to conform to the portion of the curved median to be marked further comprising removing the removable backing to expose the pressure sensitive roadway attaching adhesive before applying pressure to the spline to marry the adhesive with the surface of the portion of the curved median to be marked.

4. The method of marking a curved median with at least one marker according to claim 3, said first flange and the second flange including a plurality of flange holes for attachments, and said mechanical fasteners comprising threaded fasteners, each threaded fastener including a threaded shaft and an engageable head, and said step of attaching the spline flush to the surface of the portion of the curved median to be marked further comprising forming a plurality of median holes in the portion of the curved median to be marked beneath and in alignment with flange holes, and threading the threaded shaft of each threaded fastener through one of the flange holes and into one of the median holes aligned with and beneath said one of the flange holes.

5. The method of marking a curved median with at least one marker according to claim 1, said median being in a roadway, and said roadway having a road surface, and the surface of the portion of the curved median to be marked being above the road surface, and the step of attaching the spline flush to the surface of the portion of the curved median to be marked further comprising securing the marker to the surface of the portion of the curved median to be marked above the road surface.

6. The method of marking a curved median with at least one marker according to claim 1 said marker further comprising a plurality of spaced apart notches in the first flange, said notches facilitating bending of the device; and said step of bending the at least one marker to conform to the portion of the curved median to be marked, with the protrusion of the marker facing upwardly, and the bottom of the spline being against the surface of the portion of the curved median to be marked, comprising bending the at least one marker to form a concave side and an opposite convex side; and said step of positioning the at least one marker at the portion of the curved median to be marked comprising positioning the first flange at the concave side of the at least one marker and the second flange at the convex side of the marker.

7. The method of marking a curved median with at least one marker according to claim 1, said marker comprising a plurality of marker segments and marker joints, and said method further comprising joining the plurality of marker segments using the marker joints.

8. The method of marking a curved median with at least one marker according to claim 1, said step of providing at least one marker comprising extruding a marker body, said marker body comprising the spline, the protrusion, the first flange and the second flange, integrally formed and attaching spaced apart retro-reflective elements to the outer surface of the protrusion, each of the retro-reflective elements covering a portion of the protrusion from about the first flange to the second flange.

9. The method of marking a curved median with at least one marker according to claim 8, said step of providing at least one marker further comprising cutting a plurality of spaced apart notches into the first flange to facilitate bending.

10. The method of marking a curved median with at least one marker according to claim 9, said step of cutting a plurality of spaced apart notches into the first flange to facilitate bending comprising cutting a plurality of v-shaped notches into the first flange to facilitate bending.

11. The method of marking a curved median with at least one marker according to claim 9, said step of cutting a plurality of spaced apart notches into the first flange to facilitate bending comprising cutting a plurality of v-shaped notches with stress relief vertices into the first flange to facilitate bending.

12. The method of marking a curved median with at least one marker according to claim 9, said step of cutting a plurality of spaced apart notches into the first flange to facilitate bending comprising cutting a plurality of v-shaped notches with circular stress relief vertices into the first flange to facilitate bending.

13. The method of marking a curved median with at least one marker according to claim 3, said first flange and the second flange including a plurality of flange holes for attachments, and said mechanical fasteners comprising threaded fasteners, each threaded fastener including a threaded shaft and an engageable head, and said step of securing the marker to the surface of the portion of the curved median to be marked using mechanical fasteners further comprising forming a plurality of median holes in the portion of the curved median to be marked beneath and in alignment with flange holes, and threading the threaded shaft of each threaded fastener through one of the flange holes and into one of the median holes aligned with and beneath said one of the flange holes.

14. The method of marking a curved median with at least one marker according to claim 13, said median being in a roadway, and said roadway having a road surface, and the surface of the portion of the curved median to be marked being above the road surface, and the step of securing the marker to the surface of the portion of the curved median to be marked using the mechanical fasteners comprising securing the marker to the surface of the portion of the curved median to be marked above the road surface using the mechanical fasteners.

15. The method of marking a curved median with at least one marker according to claim 14 said marker further comprising a plurality of spaced apart notches in the first flange, said notches facilitating bending of the device; and said step of bending the at least one marker to conform to the portion of the curved median to be marked, with the protrusion of the marker facing upwardly, and the bottom of the spline being against the surface of the portion of the curved median to be marked, comprising bending the at least one marker to form a concave side and an opposite convex side; and said step of positioning the at least one marker at the portion of the curved median to be marked comprising positioning the first flange at the concave side of the at least one marker and the second flange at the convex side of the marker.

16. The method of marking a curved median with at least one marker according to claim 15, said marker comprising a plurality of marker segments and marker joints, and said method further comprising joining the plurality of marker segments using the marker joints.

17. The method of marking a curved median with at least one marker according to claim 16, said step of providing at least one marker comprising extruding a marker body, said marker body comprising the spline, the protrusion, the first flange and the second flange, integrally formed and attaching spaced apart retro-reflective elements to the outer surface of the protrusion, each of the retro-reflective elements covering a portion of the protrusion from about the first flange to the second flange.

18. The method of marking a curved median with at least one marker according to claim 17, said step of providing at least one marker further comprising cutting a plurality of spaced apart notches into the first flange to facilitate bending.

19. The method of marking a curved median with at least one marker according to claim 18, said step of cutting a plurality of spaced apart notches into the first flange to facilitate bending comprising cutting a plurality of v-shaped notches into the first flange to facilitate bending.

20. The method of marking a curved median with at least one marker according to claim 19, said step of cutting a plurality of spaced apart notches into the first flange to facilitate bending comprising cutting a plurality of v-shaped notches with stress relief vertices into the first flange to facilitate bending.

* * * * *